US006241496B1

(12) United States Patent
Kim et al.

(10) Patent No.: US 6,241,496 B1
(45) Date of Patent: Jun. 5, 2001

(54) HERMETIC ROTARY COMPRESSOR

(75) Inventors: Kwang Ho Kim; Hong Seok Seo; Sang Myung Byun; Se Jin Ku, all of Changwon; Yun Won Lee, Pusan, all of (KR)

(73) Assignee: LG Electronics, Inc. (KR)

( * ) Notice: Subject to any disclaimer, the term of this patent is extended or adjusted under 35 U.S.C. 154(b) by 0 days.

(21) Appl. No.: 09/526,156

(22) Filed: Mar. 15, 2000

(30) Foreign Application Priority Data

Nov. 5, 1999 (KR) ..... 99-48789
Nov. 5, 1999 (KR) ..... 99-48790
Nov. 5, 1999 (KR) ..... 99-48791

(51) Int. Cl.[7] ..... F03C 4/00

(52) U.S. Cl. ..... 418/63; 418/181; 418/79; 418/75

(58) Field of Search ..... 418/63, 181, 79, 418/75

(56) References Cited

U.S. PATENT DOCUMENTS 4,427,351 * 1/1984 Sano ..... 418/63
4,629,403 * 12/1986 Wood ..... 418/63
4,884,956 * 12/1989 Fujitani et al. ..... 418/63
4,927,342 * 5/1990 Kim et al. ..... 418/63
4,932,851 * 6/1990 Kim ..... 418/63
5,004,410 * 4/1991 Da Costa ..... 418/63
5,203,679 * 4/1993 Yun et al. ..... 418/63
5,605,447 * 2/1997 Kim et al. ..... 418/63

FOREIGN PATENT DOCUMENTS

936214 * 7/1955 (DE) ..... 418/63
57-032096 * 2/1982 (JP) ..... 418/63
9-151888 * 6/1997 (JP) ..... 418/63

* cited by examiner

*Primary Examiner*—Thomas Denion
*Assistant Examiner*—Theresa Trieu
(74) *Attorney, Agent, or Firm*—Ostrolenk, Faber, Gerb & Soffen, LLP

(57) ABSTRACT

The present invention relates to a hermetic rotary compressor. More particularly, since the conventional rotary compressor has problems that the effect of a surge recess for reducing noises due to pressure pulsation is insufficient, and it is impossible to obtain the maximum compression efficiency, the present invention is constructed such that noises due to pressure pulsation can be reduced to the maximum and at the same time the compressive driving force required for compressing gaseous refrigerant is decreased to thereby improve the compression efficiency. In a hermetic rotary compressor which comprises a crankshaft which has an eccentric portion formed therein and is rotated by receiving driving force of a motor unit, a rolling piston which is inserted into an eccentric portion of the crankshaft, a cylinder in which a space portion into which the rolling piston is inserted is formed to thereby form a space portion between the inner surface of the cylinder and the outer surface of the rolling piston, upper and lower bearings, each of which is connected to the cylinder to thereby enclosing the space portion and at the same time support the crankshaft, and a vane which is installed to penetrates the inner wall of the cylinder, linearly reciprocate in a radius direction of the cylinder, and linearly contact with the outer surface of the rolling piston, whereby the space portion of the cylinder is partitioned into a suction area and a compression area according to the rotation of the crankshaft, there is a provided a hermetic rotary compressor, wherein a surge recess is formed at 80~90 degrees in a rotational direction of the crankshaft from the vane, have a volume corresponding to 0.5~2% of the overall volume of the space portion, and is partially communicated with the cylinder space portion.

9 Claims, 13 Drawing Sheets

HERMETIC ROTARY COMPRESSOR

BACKGROUND OF THE INVENTION

1. Field of the Invention

The present invention relates to a hermetic rotary compressor and, in particular, to a hermetic rotary compressor which is capable of improving the effect of reducing noise due to pressure pulsation generated during a gas suction and discharge process, and at the same time improving the compressing efficiency of the compressor by reducing compressive driving force.

2. Description of the Prior Art

Generally, a rotary compressor is an apparatus for compressing gas, and there are many kinds of compressors depending on its method of compressing the gas including a rotary compressor, a reciprocating compressor, a scroll compressor, etc.

Each of these compressor includes a hermetic vessel having a certain space portion, an motor unit mounted on the hermetic vessel for thereby generating driving force, and a compression unit which receives the driving force from the motor unit for thereby compressing gas.

As an example of the above-mentioned compressors, a hermetic rotary compressor will be described as follows with reference to FIGS. 1 and 2.

FIG. 1 is a front cross-sectional view illustrating a general rotary compressor, and FIG. 2 is a horizontal cross-sectional view illustrating a general rotary compressor.

As illustrated therein, the motor unit is mounted on one side portion of the hermetic vessel 1, and the compression unit is mounted on the other side portion of the hermetic vessel at a certain distance from the motor unit.

The motor unit includes a stator 2 fixedly connected to the inner surface of the hermetic vessel 1, and a rotator 3 connected to be rotatable in the stator 2.

And, the compression unit includes a crankshaft 4 which is press-fitted to the inner diameter of the rotator 3 and has an eccentric portion 4*a* formed at one end of the crankshaft 4, and a cylinder 5 in which the eccentric portion 4*a* of the shaft 4 is inserted into a space portion 11 at which gas is sucked and compressed are mounted on the hermetic vessel.

In addition, the compression unit includes upper and lower bearings 7 and 8 which is bolted to the upper and lower surfaces of the cylinder 5 for thereby supporting the crankshaft 4 and enclosing the space portion 11 of the cylinder 5, a rolling piston positioned in the space portion 11 of the cylinder 5, revolving according to the rotation of the crankshaft 4, an eccentric portion 4*a* of the crankshaft 4 being inserted into the rolling piston 9, a vane 10 which is inserted into one side of the cylinder 5 in order to linearly reciprocate in a radius direction of the cylinder 5 as one end of the vane 10 contacts the outer surface of the rolling piston 9 during the rotation of the rolling piston 9, whereby the space portion formed by the inner surface of the cylinder 5 and the outer surface of the rolling piston 9 is partitioned into a suction area 11*a* and a compression area 11*b*.

And, a suction hole 5*a* through which gas is sucked into the cylinder 5 is formed in the suction area 11*a* of the cylinder 5, more specifically, at one side of the cylinder 5 neighboring the vane 10. A discharge port 5*b* through which compressed gas is discharged is formed in the compression area 11*b* of the cylinder 5, that is, at the other side of the cylinder 5 neighboring the vane 10. The above discharge port 5*b* is communicated with a discharge hole 7*a* formed at the upper bearing 7, and the discharge hole 7*a* can be formed at the lower bearing 8 connected to the lower surface of the cylinder 5.

A inlet pipe 12 through which gas is sucked is connected to a side wall of the hermetic vessel 1, a outlet pipe 13 through which gas is discharged is connected to the upper side of the hermetic vessel 1, and oil(not shown) is filled in the bottom of the hermetic vessel 1.

In the drawings, reference numeral 14 denotes a discharge valve, 15 denotes a retainer, 16 denotes a muffler, and 17 denotes an accumulator.

The operation of the above general hermetic rotary compressor will be described as follows.

When the crankshaft 4 is rotated by an applied current, along with the rotator 3, the rolling piston 9 connected to the eccentric portion 4*a* of the crankshaft 4 is revolved around the crankshaft 4 in the cylinder space portion 11 while being in contact with the vane 10.

Due to the volume change of the space portion 11 formed by the inner surface of the cylinder 5 and the outer surface of the rolling piston 9 by the revolution of the rolling piston 9, a gaseous refrigerant of low temperature and pressure is sucked into the space portion 11 of the cylinder 5 through the inlet pipe 12 and the suction hole 5*a* to thereafter be compressed into gas of high temperature and pressure, and the compressed gaseous refrigerant of high temperature and pressure is discharged through the discharge port 5*b*, the discharge hole 7*a*, and the discharge valve 14.

Herein, the process in which gaseous refrigerant is sucked, compressed, and then discharged according to the rotation of the crankshaft 4 will be described in more detail with reference to FIGS. 3, 4, and 5.

FIGS. 3, 4, and 5 are horizontal cross-sectional views illustrating the operational process of the rotary compressor.

First, as shown in FIG. 3, when the semimajor axial front end (A) of the eccentric portion 4*a* of the crankshaft 4 is in contact with the vane 10, the discharge stroke is terminated and at the same time the suction stroke is terminated.

And, as the crankshaft 4 is rotated, and thereby the space portion 11 is converted to the suction area 11*a* and the compression area 11*b* by the vane 10 at a position that the semimajor axial front end of the eccentric portion 4*a* is displaced from the vane by 180 degrees as illustrated in FIG. 4, gaseous refrigerant is sucked into the suction area 11*a* and at the same time the volume of the compression area 11*a* is reduced, whereby the gas is progressively compressed.

And, when the crankshaft 4 is rotated, and thereby the semimajor axial front end of the eccentric portion 4*a* passes an angle of 180 degrees and then moves to the discharge port 5*b*, the amount of gaseous refrigerant sucked into the suction area 11*a* and the pressure of the compression area 11*b* is increased at the same time, whereby the pressure of the compression area 11*b* becomes higher compared to discharged gas. In this case, the discharge valve 14 is opened, and compressed gas is discharged through the discharge port 5*b* and the discharge hole 7*a*.

Meantime, when the rolling piston 9 continues to repeat the process of sucking, compressing, and discharging gaseous refrigerant while revolving during the operation of the above compressor, noises due to pressure pulsation are generated. In this regard, many studies for reducing noises due to pressure pulsation is in progress in order to obtain an resonance effect at the space portion 11 of the cylinder 5.

With reference to FIGS. 6 and 7 illustrating an embodiment of a conventional noise reduction structure in order to reduce the above-mentioned pressure pulsation, a surge recess 18, an unpierced hole having a certain diameter and depth, is formed between 150 and 270 degrees from the vane 10 in a rotational direction of the crankshaft 4.

With respect to the position at which the above surge recess 18 is formed, there arises a malfunction that compressed gas flows back to the suction side at every angles at which the surge recess 18 is formed. When the angle is increased, the loss of re-expansion is increased as much, while the compression work(compressive driving force) of the compressor according to the surge recess 18 is decreased, thereby obtaining a gain of compressive driving force.

In regard to compression efficiency, when the performance of the compressor is analyzed based on a P-V diagram in FIG. 8, there arises a difference between a re-expansion loss and a compressive driving force gain within the space portion according to each position of the crankshaft in the process of the compression stroke during a single rotation of the crankshaft.

That is, it is shown that if the rolling piston 9 is positioned at 24 degrees from the vane 10, the re-expansion loss and the compressive volume gain or compressive driving force gain are small, if positioned at 90 degrees, the compressive volume gain of gas to be compressed becomes larger than the re-expansion loss thereof, and if positioned at 160 degrees, the compressive volume gain of gas to be compressed becomes smaller than the re-expansion loss thereof.

However, in the above-described conventional noise reduction structure, a simple tubular type unpierced hole is formed, so that noise reduction using resonance effect is not enough. Also, the unpierced hole is placed at a position of a high compressed state during the compression, thereby causing a re-expansion loss.

In addition, the conventional noise reduction structure is a certain set range considering only the discharge side with regard to pulsation noise reduction, rather than a proper range considering compressing efficiency as well.

Therefore, considering the above description, in the conventional rotary compressor, there is a problem that the surge recess for reducing noises due to pressure pulsation cannot maximize noise reduction, and the compressing efficiency is reduced.

SUMMARY OF THE INVENTION

Accordingly, it is an object of the present invention to provide a hermetic rotary compressor which is capable of minimize noise reduction due to pressure pulsation generated in a compression unit during the operation of the compressor, and at the same time improving the efficiency of the compressor.

To achieve the above objects, in a hermetic rotary compressor which comprises a crankshaft which has an eccentric portion formed therein and is rotated by receiving driving force of a motor unit, a rolling piston which is inserted into an eccentric portion of the crankshaft, a cylinder in which a space portion into which the rolling piston is inserted is formed to thereby form a space portion between the inner surface of the cylinder and the outer surface of the rolling piston, upper and lower bearings, each of which is connected to the cylinder to thereby enclosing the space portion and at the same time support the crankshaft, and a vane which is installed to penetrates the inner wall of the cylinder, linearly reciprocate in a radius direction of the cylinder, and linearly contact with the outer surface of the rolling piston, whereby the space portion of the cylinder is partitioned into a suction area and a compression area according to the rotation of the crankshaft, there is a provided a hermetic rotary compressor, wherein a surge recess is formed at 80~90 degrees in a rotational direction of the crankshaft from the vane in the hermetic space portion.

The surge recess has a volume corresponding to 0.5%–2% of the overall volume of the space portion.

When the lower bearing is connected with the cylinder, the opening of the surge recess is divided into an overlap part which overlaps with the cylinder and a communicating part which is communicated to the space portion of the cylinder.

The maximum length of the communicating part is formed to be less than 55% of the thickness(t) of the rolling piston 9 from the inner surface of the cylinder.

The surge recess is elliptical or square.

The surge recess is formed at the lower bearing.

The vertical cross sectional shape of the surge recess is formed to have a projection on one side wall.

Additional advantages, objects and features of the invention will become more apparent from the description which follows.

BRIEF DESCRIPTION OF THE INVENTION

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Preferred embodiments of the present invention will now be described with reference to the accompanying drawings.

Figure 1:
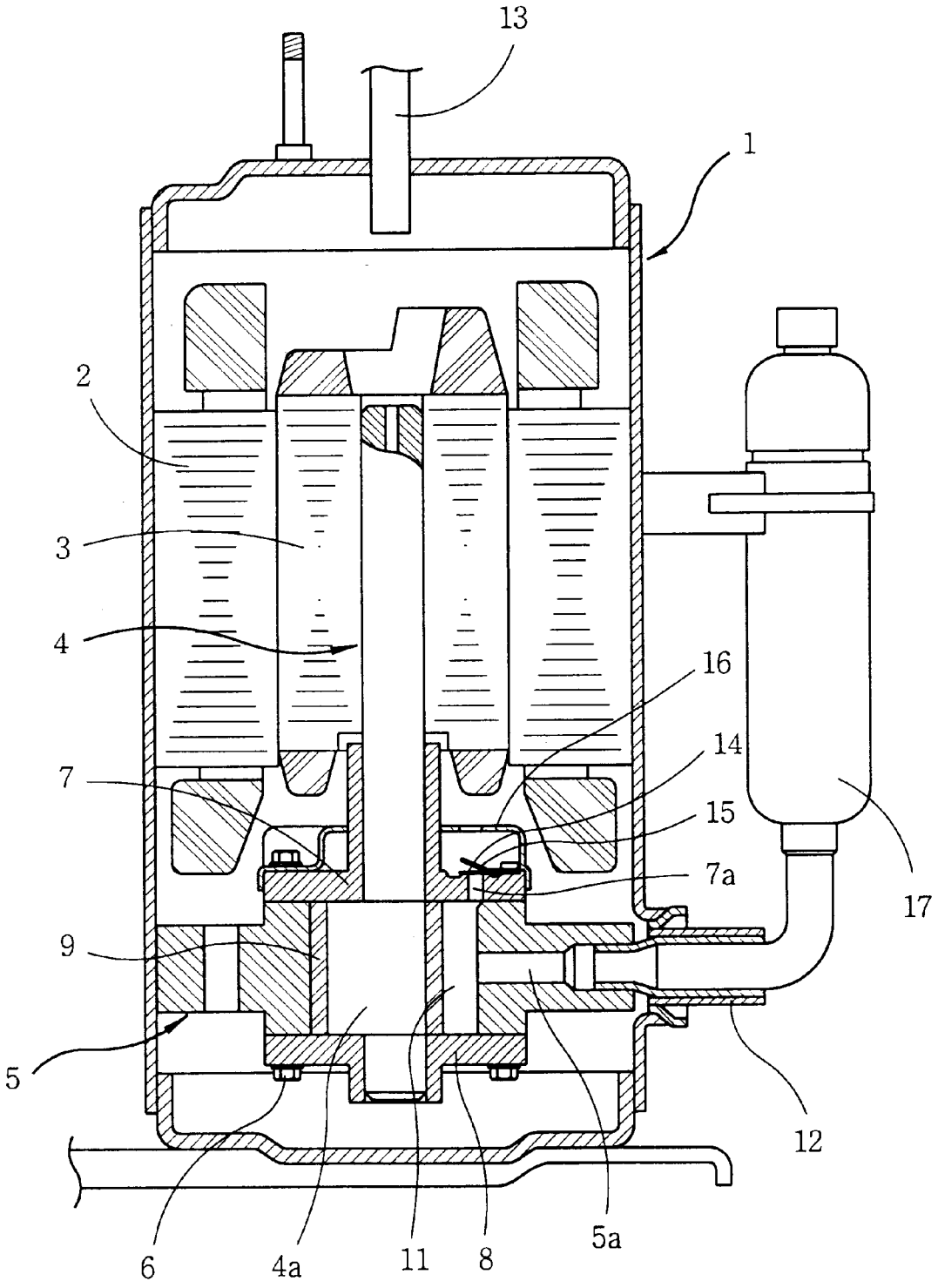
FIG.1 CONVENTIONAL ART
FIG. 1 is a front cross-sectional view illustrating a general hermetic rotary compressor.
Figure 2:
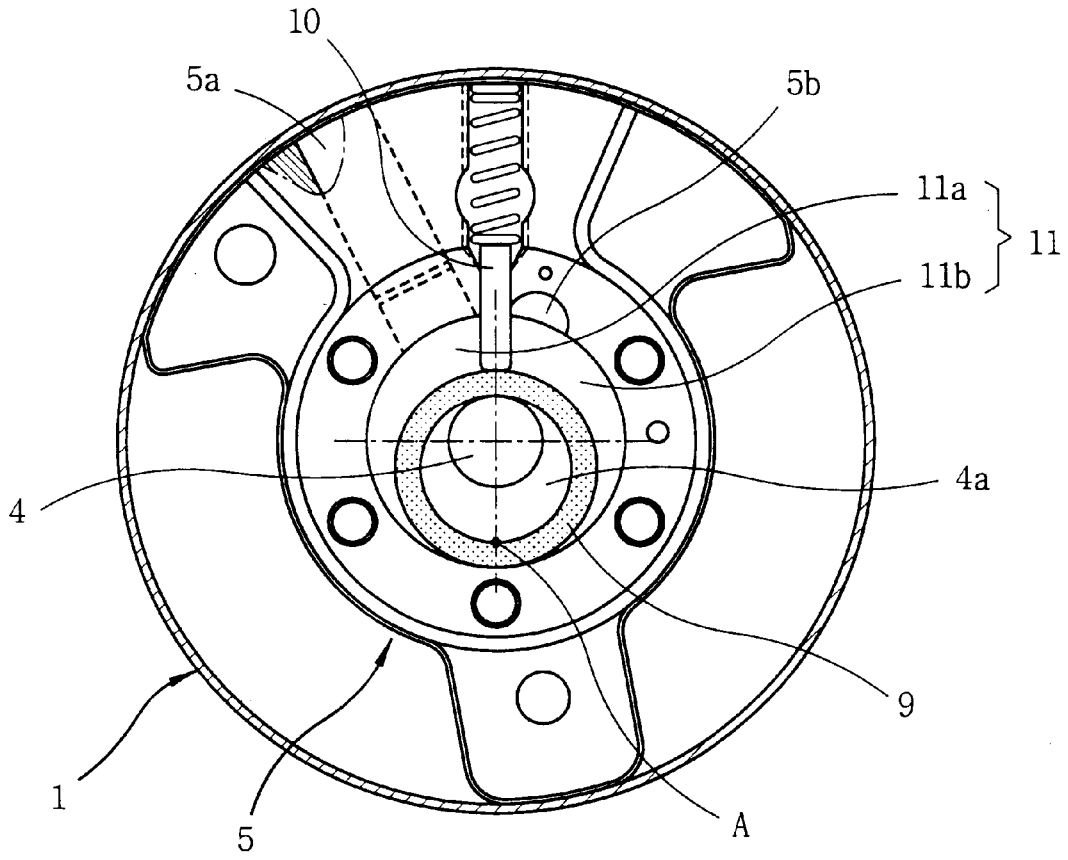
FIG.2 CONVENTIONAL ART
FIG. 2 is a horizontal cross sectional view illustrating a compression unit of a general hermetic rotary compressor.
Figure 3:
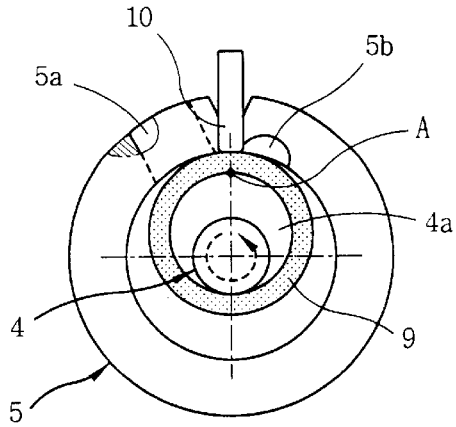
FIG.3 CONVENTIONAL ART
FIGS. 3 through 5 are horizontal cross-sectional views illustrating the operational process of a conventional rotary compressor.
Figure 4:
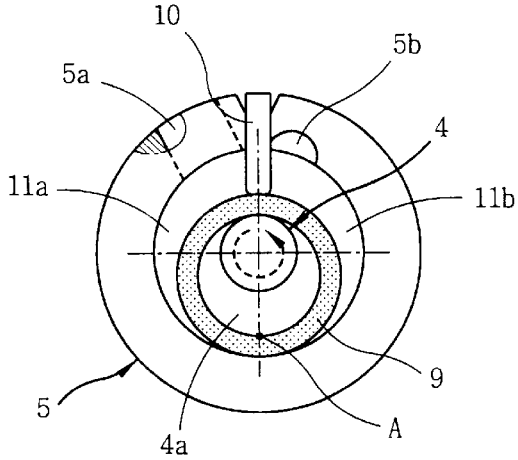
FIG.4 CONVENTIONAL ART
Figure 5:
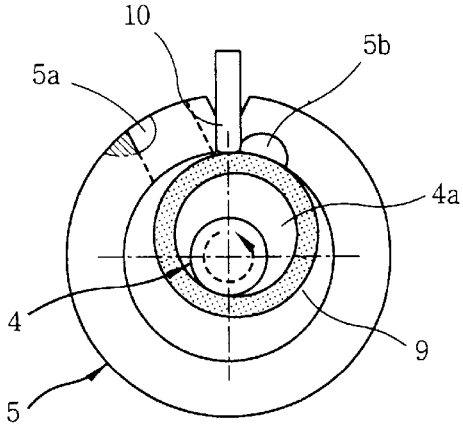
FIG.5 CONVENTIONAL ART
Figure 6:
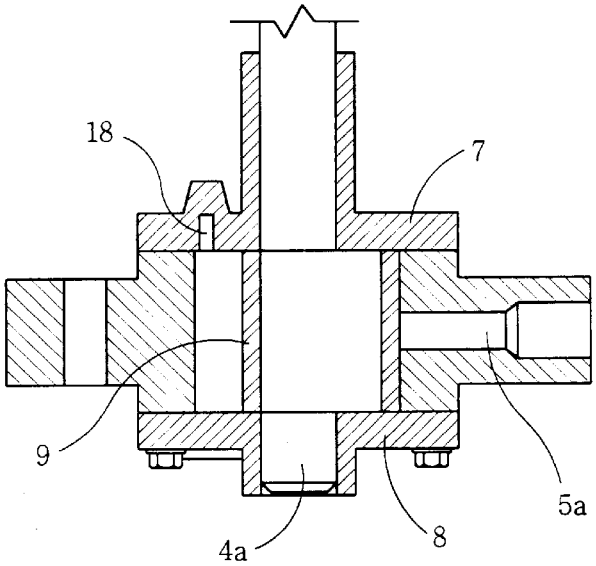
FIG.6 CONVENTIONAL ART
FIG. 6 is a front cross-sectional view illustrating an embodiment of the noise reduction structure for a conventional rotary compressor.
Figure 7:
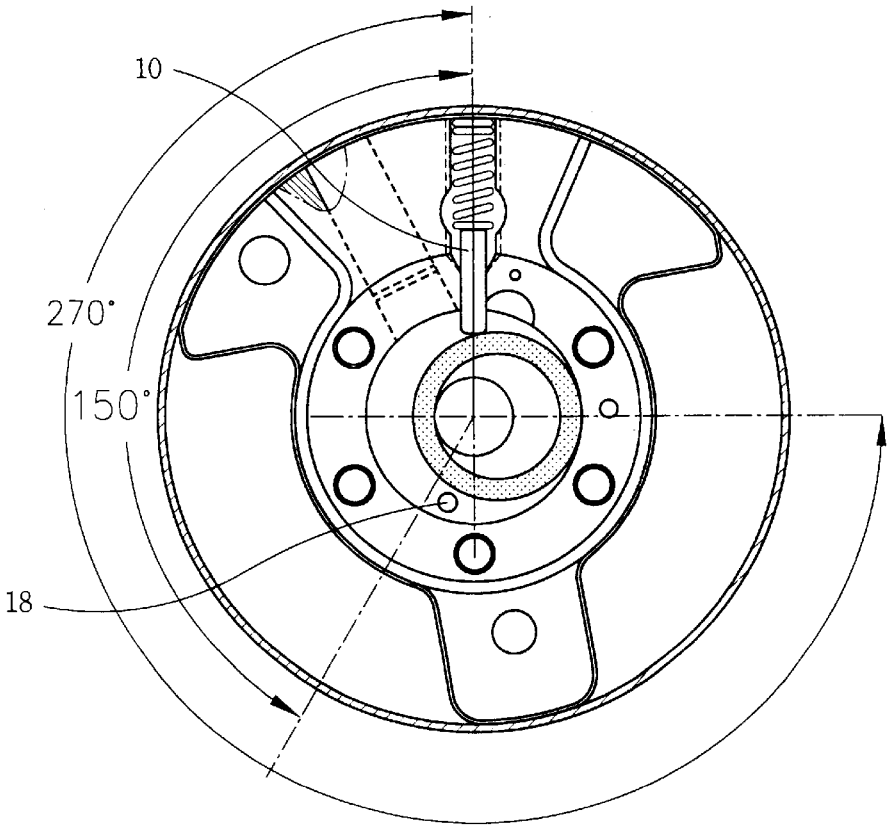
FIG.7 CONVENTIONAL ART
FIG. 7 is a horizontal cross-sectional view illustrating an embodiment of the noise reduction structure for a conventional rotary compressor.
Figure 8:
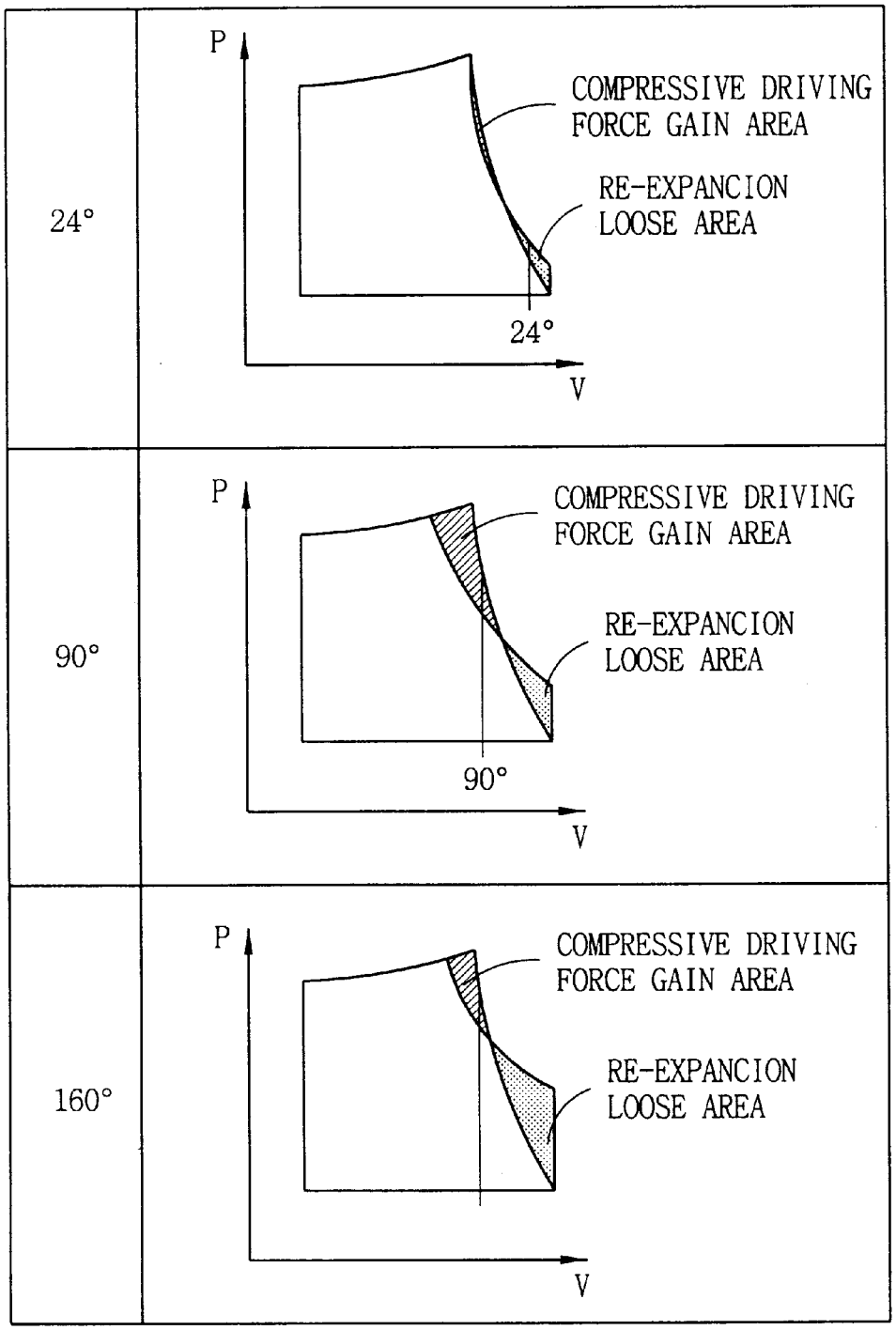
FIG.8 CONVENTIONAL ART
FIG. 8 is a P-V diagram showing states of a general rotary compressor by angles.
Figure 9:
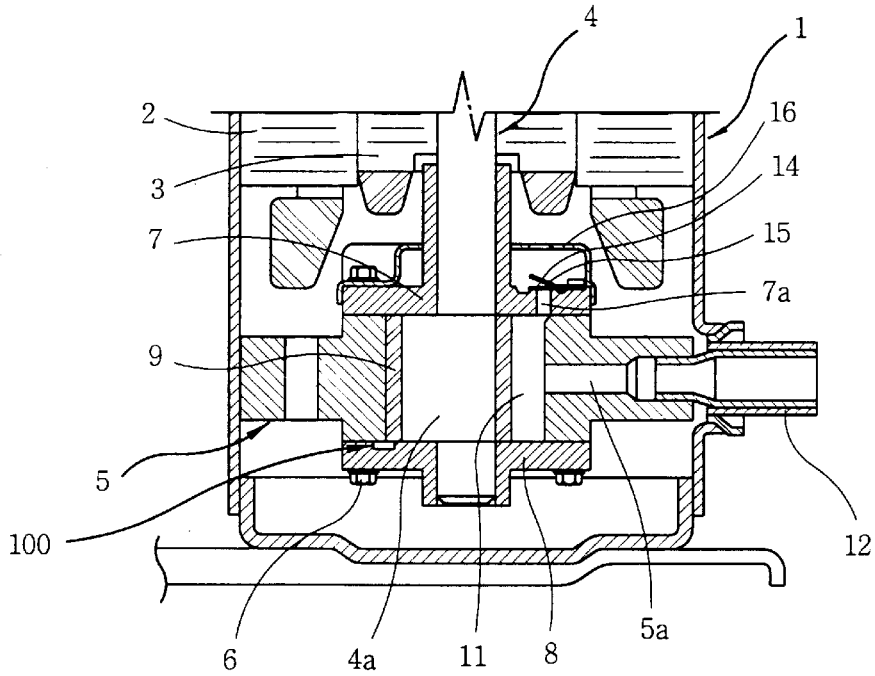
FIG. 9 is a partial front cross-sectional view illustrating a rotary compressor with a noise reduction structure according to the present invention.
Figure 10:
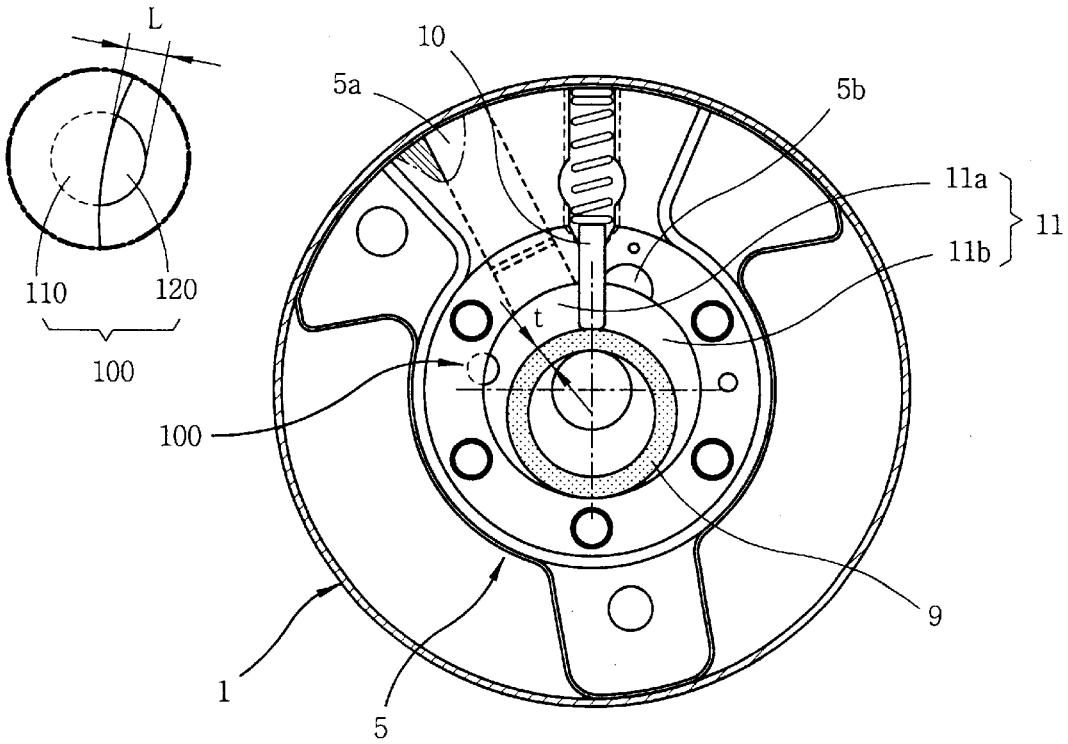
FIG. 10 is a horizontal cross-sectional view illustrating a compression unit of a rotary compressor with a noise reduction structure in accordance with a first embodiment of the present invention.

FIG. 9 and FIG. 10 are a partial front cross-sectional view and a horizontal cross-sectional view, respectively, illustrating a hermetic rotary compressor with a noise reduction structure and an efficiency improvement structure in accordance with the present invention. The elements identical with the conventional ones are denoted by the same reference numerals.

As illustrated therein, the hermetic rotary compressor in accordance with the present invention is comprised of a motor unit for generating driving force and a compression unit for compressing gas by receiving the driving force of the motor unit, and is installed in a hermetic vessel 1.

The motor unit includes a stator 2 fixedly connected to the inner surface of the hermetic vessel 1, and a rotator 3 connected to be rotatable in the stator 2.

And, the compression unit is constructed such that a crankshaft 4 which is press-fitted to the inner diameter of the rotator 3 and has an eccentric portion 4*a* formed at one end of the crankshaft 4, and a cylinder 5 in which the eccentric portion 4*a* of the shaft 4 is inserted into a space portion 11 at which gas is sucked and compressed are coupled in the hermetic vessel.

In addition, the compression unit includes upper and lower bearings 7 and 8 which is bolted to the upper and lower surfaces of the cylinder 5 for thereby supporting the crankshaft 4 and enclosing the space portion 11 of the cylinder 5, a rolling piston which has the eccentric portion 4*a* of the crankshaft 4 inserted thereinto and is positioned in the space portion 11 of the cylinder 5 to thereby revolve according to the rotation of the crankshaft 4, a vane 10 which is inserted into one side of the cylinder 5 in order to linearly reciprocate in a radius direction of the cylinder 5 as one end of the vane 10 contacts the outer surface of the rolling piston 9 during the rotation of the rolling piston 9, whereby the space portion formed by the inner surface of the cylinder 5 and the outer surface of the rolling piston 9 is partitioned into a suction area 11*a* and a compression area 11*b*.

And, a suction hole 5*a* through which gas is sucked into the cylinder 5 is formed in the suction area 11*a* of the cylinder 5, more specifically, at one side of the cylinder 5 neighboring the vane 10. A discharge port 5*b* through which compressed gas is discharged is formed in the compression area 11*b* of the cylinder 5, that is, at the other side of the cylinder 5 neighboring the vane 10. The above discharge port 5*b* is communicated with a discharge hole 7*a* formed at the upper bearing 7, and a discharge valve 14 for opening and/or closing the discharge hole 7*a* is installed on the discharge port 5*b*.

Herein, the discharge hole 7*a* can be formed at the lower bearing 8 connected to the lower surface of the cylinder 5.

And, a surge recess 100 is formed at one end of the lower bearing 8 in order to be positioned at 70~100 degrees in a rotational direction of the crankshaft 4 from the vane 10 and be partially communicate with the hermetic space portion 11 of the cylinder 5.

At this time, when the lower bearing 8 is connected with the cylinder 5, the opening 110 of the surge recess 100 is divided into an overlap part 110 which overlaps with the cylinder and a communicating part 120 which is communicated to the space portion of the cylinder 5. The length from the inner surface of the cylinder 5 to the back end of the communicating part 120 is formed to be less than 55% of the thickness(t) of the rolling piston 9.

Figure 11:
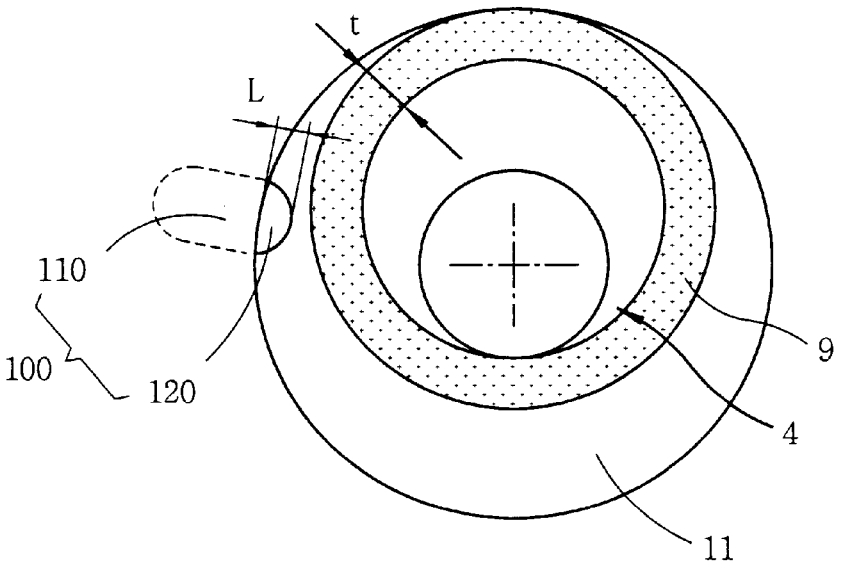
FIG. 11 is a horizontal cross-sectional view illustrating a compression unit of a rotary compressor with a noise reduction structure in accordance with a second embodiment of the present invention.
Figure 12:
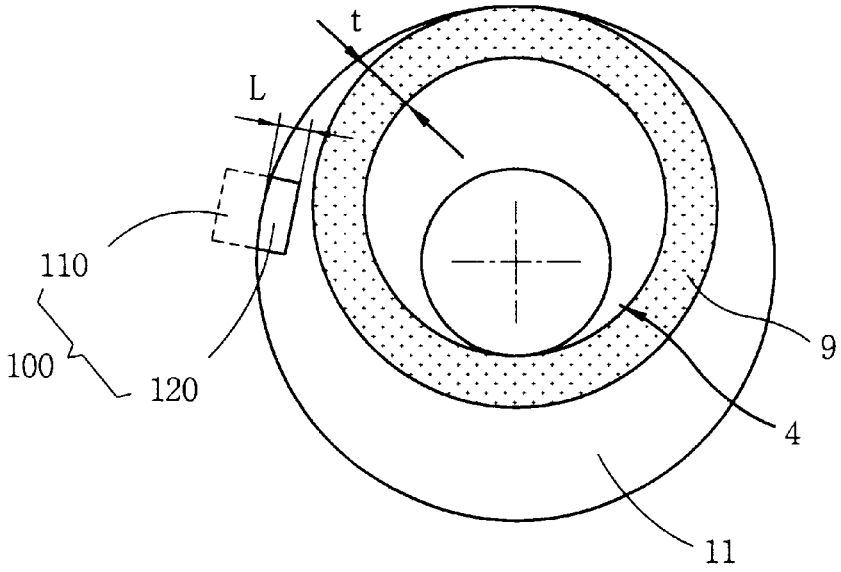
FIG. 12 is a horizontal cross-sectional view illustrating a compression unit of a rotary compressor with a noise reduction structure in accordance with a third embodiment of the present invention.

Herein, the surge recess 100 is formed into a cylindrical shape with a certain inner diameter and depth, or can be formed into an elliptical cylindrical shape whose section is elliptical in accordance with a second embodiment of the present invention as illustrated in FIG. 11. In this case, also, when the lower bearing 8 is connected with the cylinder 5, the opening 110 of the surge recess 100 is divided into an overlap part 110 which overlaps with the cylinder and a communicating part 120 which is communicated to the space portion of the cylinder. The length from the inner surface of the cylinder 5 to the back end of the communicating part 120 is formed to be less than 55% of the thickness(t) of the rolling piston 9.

Figure 13A:
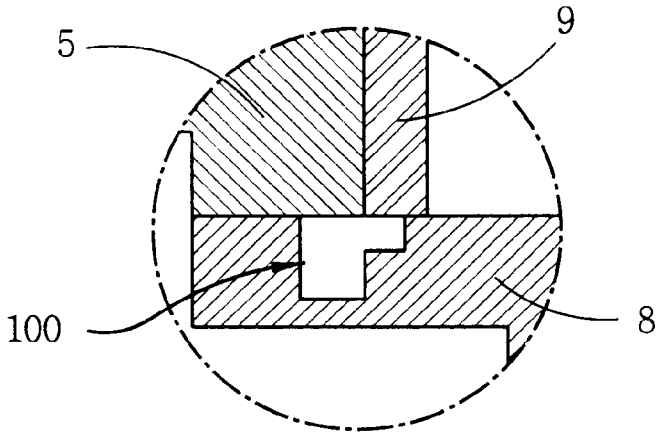
FIG. 13A is a magnified view illustrating a first embodiment of a vertical cross section of a noise reduction structure in accordance with the present invention.
Figure 13B:
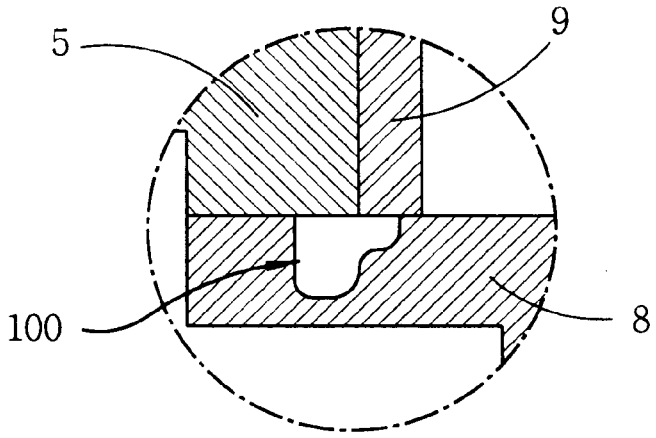
FIG. 13B is a magnified view illustrating a second embodiment of a vertical cross section of a noise reduction structure in accordance with the present invention.

And, the vertical cross-section of the surge recess 100 is formed to have a projection of curved surface steps as illustrated in FIGS. 13A and 13B.

In addition, the volume of the surge recess 100 is formed to be 0.5%~2% of the volume of the space portion 11 which is a space between the inner surface of the cylinder 5 and the outer surface of the rolling piston 9, that is, the overall suction volume of gas.

The surge recess 100 can be formed at either the upper bearing 7 or the lower bearing 8, but preferably formed at the lower bearing 8.

In the drawings, reference numeral 15 designates a retainer, and 16 designates a muffler.

Hereinafter, the operation of the rotary compressor according to the present invention will be described below with reference to FIGS. 14, 15 and 16.

As shown therein, when the crankshaft 4 is rotated along with the rotator 3 comprising the motor unit by applying power, the rolling piston 9 connected to the eccentric portion 4*a* of the crankshaft 4 is revolved in the space portion of the cylinder 5 in by the rotation of the crankshaft 4 while being in contact with the vane 10.

By the rotation of the rolling piston 9, gaseous refrigerant of a low temperature and pressure is sucked into the space portion 11 of the cylinder 5 through the suction pipe(not shown) and the suction hole 5*a* due to the volume change of the space portion 11 of the cylinder 5 partitioned by the vane 10 to thereby being compressed to a high temperature and pressure, and the compressed gaseous refrigerant of a high temperature and pressure is discharged through the discharge port 5*b* and the discharge hole 7*a* as the discharge valve 14 is opened.

Figure 14:
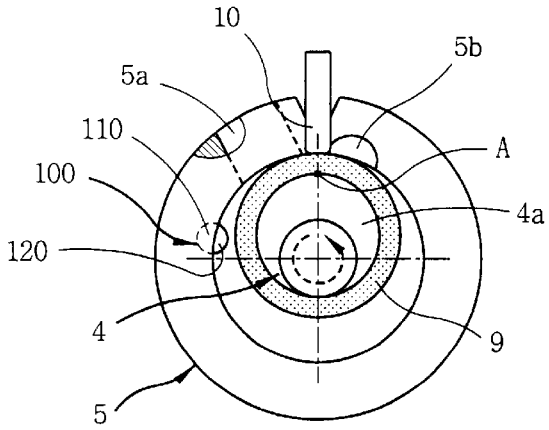
FIGS. 14 through 16 are horizontal cross-sectional views illustrating the operational process of a hermetic rotary compressor in accordance with the present invention.

More specifically, as illustrated in FIG. 14, when the semimajor axial front end (A) of the eccentric portion 4*a* of the crankshaft 4 is held to be in contact with the vane 10, the discharge stroke is terminated and at the same time the suction stroke is terminated.

Figure 15:
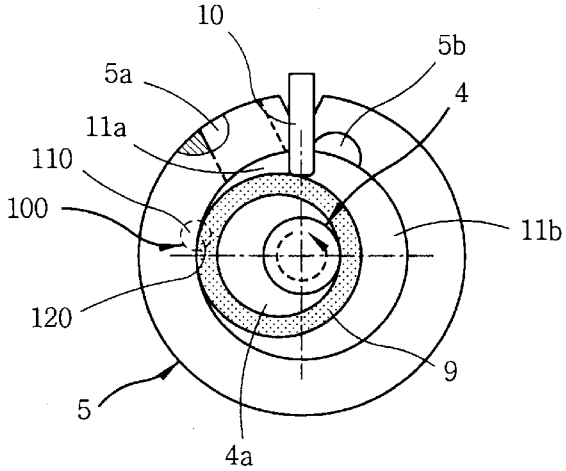

And, in the process that the front end (A) of the eccentric 4*a*, as shown in FIG. 15, reaches a position via the surge recess 100 by the rotation of the crankshaft 4, as the hermetic space portion is converted into a suction area and a compression area 11*b* by the vane 10, gaseous refrigerant is sucked into the suction area 11*a* and at the same time the volume of the suction area 11*b* is reduced, whereby the gas is gradually compressed.

Figure 16:
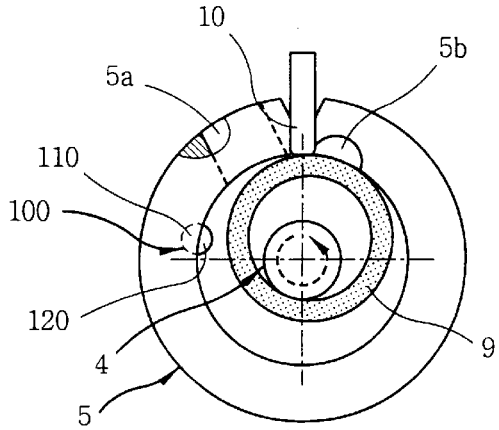

Furthermore, as shown in FIG. 16, in the process that the front end (A) of the eccentric portion 4*a* reaches the position of the discharge port 5*b* via the surge recess 100, the amount of gaseous refrigerant sucked into the suction area 11*a* is increased and at the same time the gas compressed in the compression area 11*b* is discharged through the discharge port 5*b* and the discharge hole 7*a* as the discharge valve 15 is opened.

As the above-described process is continuously repeated, gas is compressed, and noises due to pressure pulsation generated during the process is reduced by the surge recess 100.

The effects of the hermetic rotary compressor with a surge recess in accordance with the present invention will be described in more detail as follows with reference to the accompanying drawings.

Figure 17A:
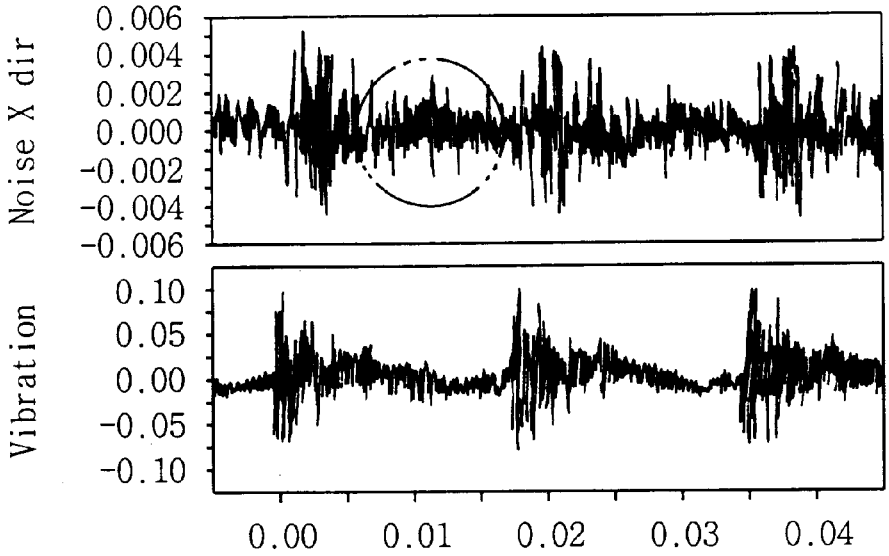
FIG. 17A is a graph measuring noises generated by operating a compressor in the condition that a noise reduction structure in accordance with the present invention is formed.
Figure 17B:
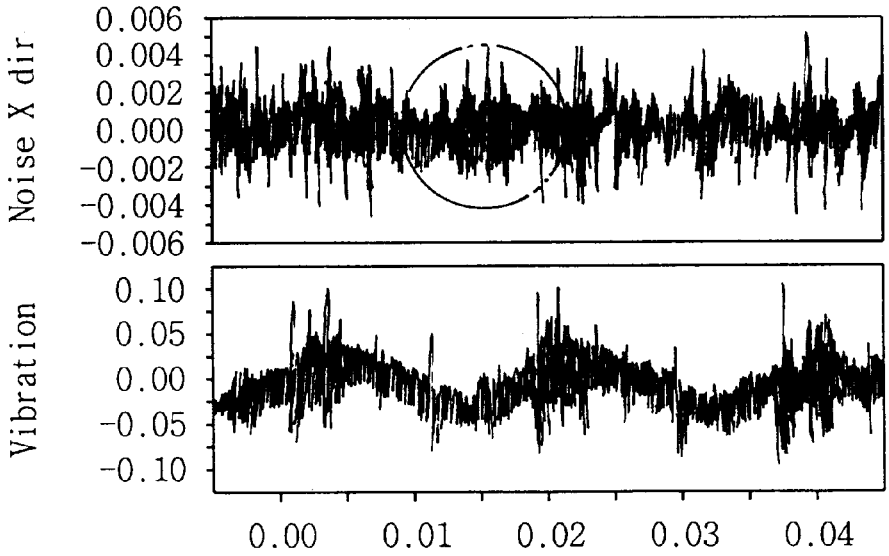
FIG. 17B is a graph measuring noises generated by operating a compressor in the condition that a noise reduction structure in accordance with the present invention is not formed.
Figure 18:
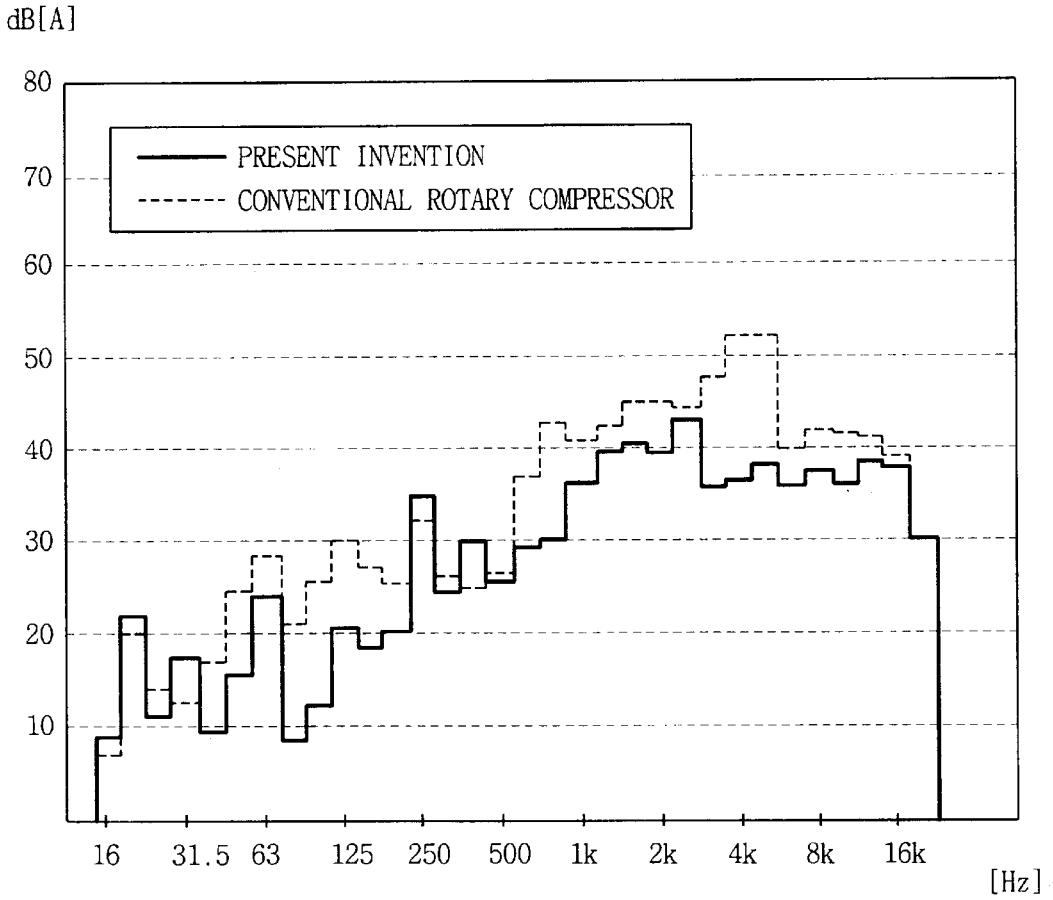
FIG. 18 is a graph illustrating a noise spectrum in accordance with the present invention as compared to the conventional art.

FIG. 17A is a graph measuring noises generated by operating a compressor in the condition that a surge recess 100 in accordance with the present invention is formed, FIG. 17B is a graph measuring noises generated by operating a compressor in the condition that a surge recess 100 in accordance with the present invention is not formed, and FIG. 18 is a graph illustrating a noise spectrum in accordance with the present invention as compared to the conventional art;

As shown in FIGS. 17A and. 17B, noises of a compressor of the present invention are substantially reduced compared to a compressor without a surge recess, at a portion at which compression and suction of gaseous refrigerant is performed simultaneously, that is, at 90 degrees.

Figure 19:
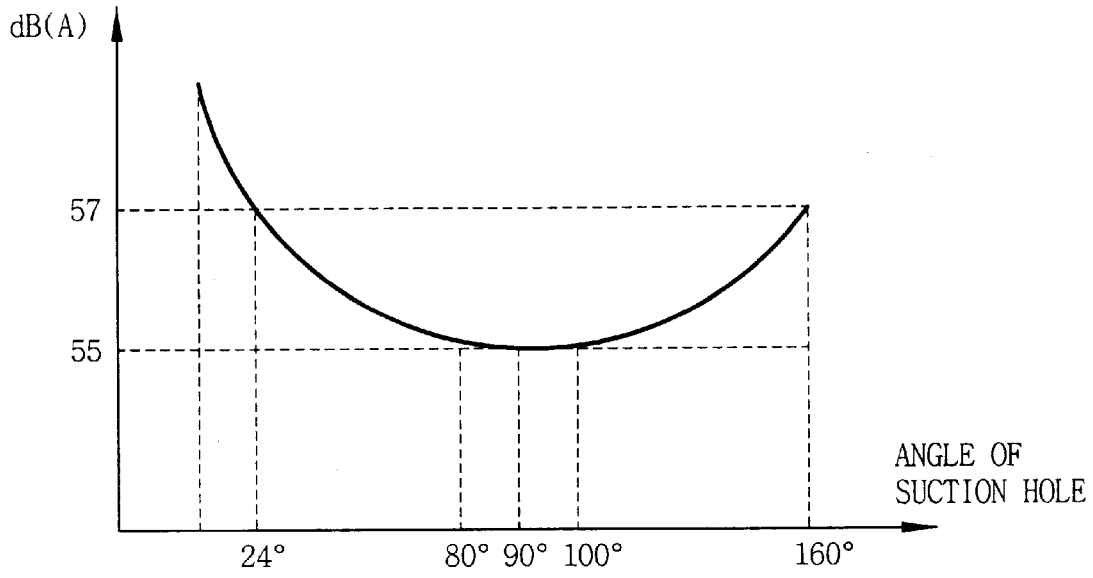
FIG. 19 is a graph illustrating the measurements of noise generation states according to each position of a surge recess formed in a rotary compressor.
Figure 20:
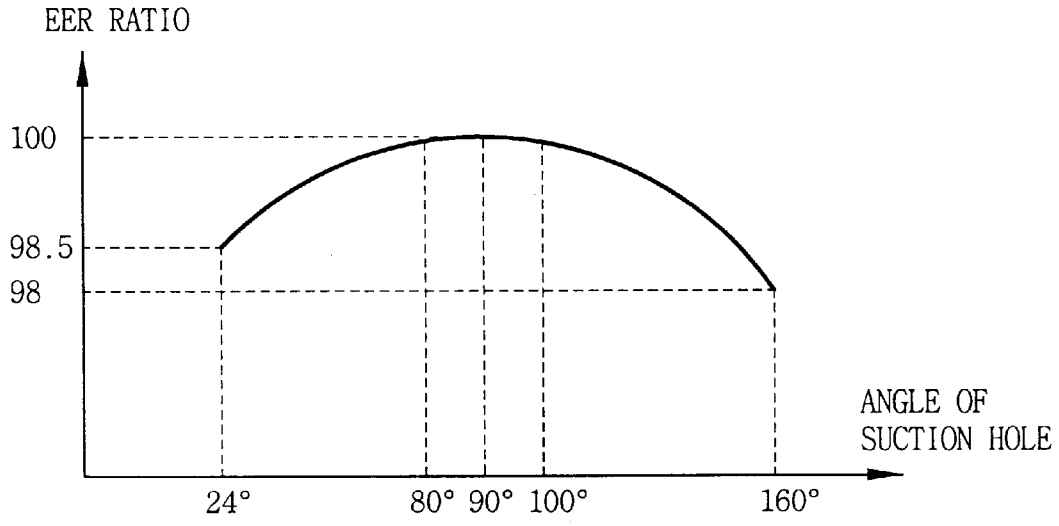
FIG. 20 is a graph illustrating the measurements of compression efficiency states by measuring the noise generation states according to each position of a surge recess formed in a rotary compressor.

In addition, FIG. 19 is a graph illustrating the measurements of noise generation states according to each position of a surge recess formed in a rotary compressor, and FIG. 20 is a graph illustrating the measurements of compression efficiency states by measuring the noise generation states according to each position of a surge recess formed in a rotary compressor.

As shown in FIG. 19, when the surge recess 100 is installed at an angle between 80 and 90 degrees as a result of measuring noise generated by operating the compressor at many angle s where the surge recess 100 is formed, reduction effect of noise, in detail, sensible noise is great.

In addition, FIG. 20 is a graph illustrating results of measuring the compressor efficiency generated by imperating a compressor at many angles where a surge recess 100 is formed, representing the maximum effect of compressor efficiency when the surge recess 100 is formed at an angle between 80 and 90.

Figure 21:
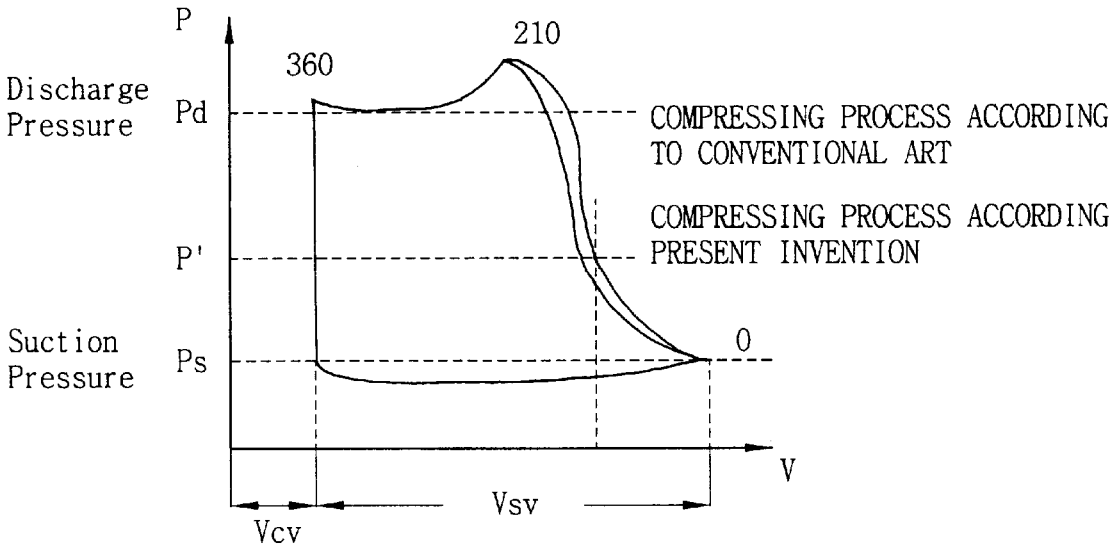
FIG. 21 is a P-V diagram illustrating the pressure and volume of a hermetic rotary compressor as compared to the conventional art.

And, FIG. 21 is a P-V diagram illustrating the pressure and volume of a hermetic rotary compressor as compared to the conventional art. By this, it is shown that compressive driving force required for gas compression is substantially reduced compared to the conventional rotary compressor, which is given by the following relational expression of compression generally well-known:

$$Pc=Ps(Vs/Vc)^k,$$

where Pc is the pressure of the compression area 11*b*, Ps is a the pressure of the suction area 11*a*, Vs is the volume of the suction area 11*a*, Vc is the volume of the compression area 11*b*, and k is the polytropic exponent.

The hermetic rotary compressor in accordance with the present invention thus described has effects of reducing noise due to pressure pulsation generated during the suction, compression, and discharge of gaseous refrigerant to the maximum by forming a surge recess with a certain volume and opening, ratio at 80~90 degrees in a rotational direction of the crankshaft 4 from the vane 10, and at the same time decreasing compressive driving force required for compressing gaseous refrigerant to thereby improve the compression efficiency.

What is claimed is:

1. In a hermetic rotary compressor which comprises a crankshaft which has an eccentric portion formed therein and is rotated by receiving driving force of a motor unit, a rolling piston which is inserted into an eccentric portion of the crankshaft, a cylinder in which a space portion into which the rolling piston is inserted is formed to thereby form a space portion between the inner surface of the cylinder and the outer surface of the rolling piston, upper and lower bearings, each of which is connected to the cylinder to thereby enclosing the space portion and at the same time support the crank shaft, and a vane which is installed to penetrate the inner wall of the cylinder, linearly reciprocate in a radius direction of the cylinder, and linearly contact with the outer surface of the rolling piston, whereby the space portion of the cylinder is partitioned into a suction area and a compression area according to the rotation of the crankshaft, a hermetic rotary compressor, wherein a surge recess is formed at 80~90 degrees in a rotational direction of the crankshaft from the vane in the hermetic space portion.

2. The compressor of claim 1, wherein, said surge recess has a volume corresponding to 0.5%–2% of the overall volume of the space portion.

3. The compressor of claim 2, wherein when said lower bearing is connected with said cylinder, the opening of said surge recess is divided into an overlap part which overlaps with the cylinder and a communicating part which is communicated to said space portion of the cylinder.

4. The compressor of claim 3, wherein the maximum length of said communicating part is formed to be less than 55% of the thickness(t) of said rolling piston 9 from the inner surface of said cylinder.

5. The compressor of claim 2, wherein said surge recess is elliptical.

6. The compressor of claim 2, wherein said surge recess is square.

7. The compressor of claim 1, wherein said surge recess is formed at said lower bearing.

8. The compressor of claim 1, wherein said vertical cross sectional shape of said surge recess is formed to have a projection on one side wall.

9. The compressor of claim 8, wherein said projection is formed of curved surface steps.

* * * * *